United States Patent [19]

Michaels et al.

[11] 3,951,498

[45] Apr. 20, 1976

[54] ELECTRICAL CONNECTOR

[75] Inventors: Leonard H. Michaels, Warrenville; Edgar W. Cooney, Markham, both of Ill.

[73] Assignee: Molex Incorporated, Lisle, Ill.

[22] Filed: Jan. 10, 1975

[21] Appl. No.: 540,092

[52] U.S. Cl. ..... 339/19; 339/217 S

[51] Int. Cl.[2] ..... H01R 31/08

[58] Field of Search ..... 339/217 R, 217 S, 198 R, 339/176 M, 176 R, 19, 222, 252 R, 252 P

[56] References Cited

UNITED STATES PATENTS

| | | | |
|---|---|---|---|
| 3,172,718 | 3/1965 | Lalonde | 339/176 M |
| 3,193,795 | 7/1965 | Krehbiel | 339/217 S |

*Primary Examiner*—Joseph H. McGlynn
*Assistant Examiner*—James W. Davie
*Attorney, Agent, or Firm*—Louis A. Hecht

[57] ABSTRACT

An electrical connector generally including an insulated housing having a plurality of like terminals received therein. The housing includes a hollow chamber portion having two facing walls. One of the walls includes a plurality of upstanding protrusions formed on the interior thereof while the other wall has a plurality of cavities formed therethrough to allow communication into the chamber portion. Each cavity is in alignment with a protrusion. Each terminal includes a crimp portion at one end, an indexing portion at the other end having an opening formed therein and a resilient barrel-shaped portion intermediate the ends. The contact portion has a cross section larger than any other portion of the terminal and also the size of the cavities. The contact portion is changeable between a normally expanded configuration and any one of a plurality of contracted configurations and is contractable to squeeze through a cavity into said chamber whereupon the contact portion assumes its normal expanded configuration and the index opening at the end of the terminal receives the corresponding protrusion to position the terminal. The cavities are transversely spaced a given distance so that the contact portions of any two terminals inserted into the chamber portion through adjacent cavities resiliently press against each other.

13 Claims, 5 Drawing Figures

FIG. 1
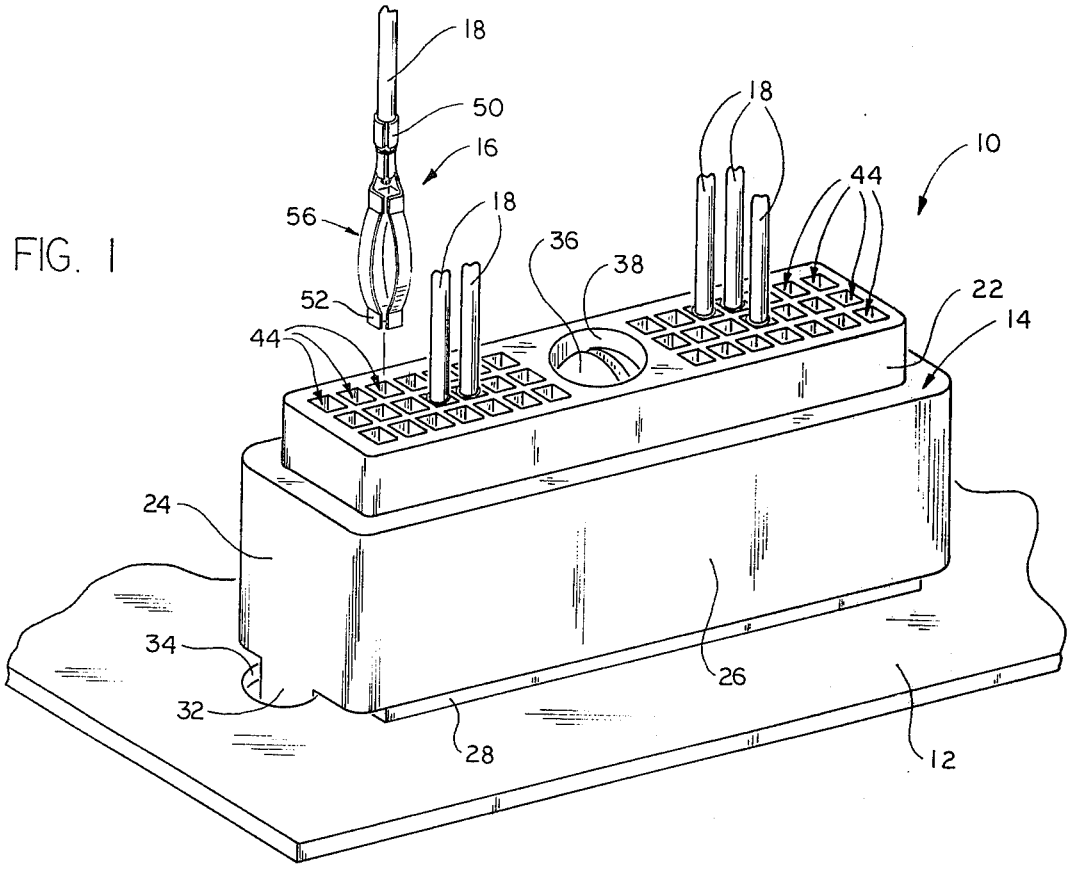
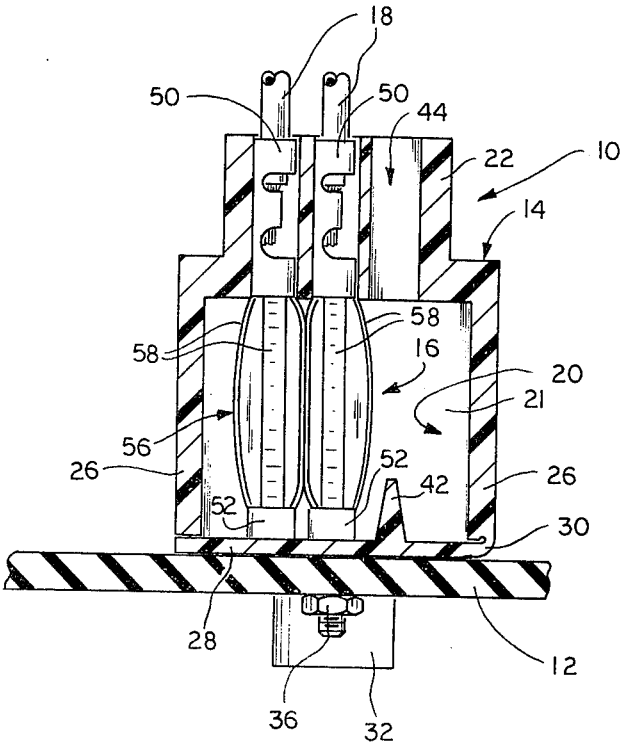
FIG. 2

FIG. 3
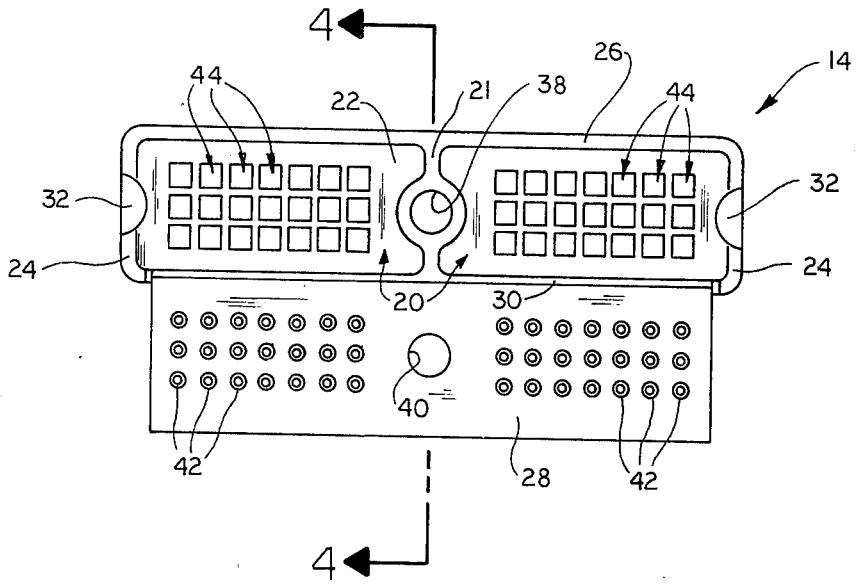
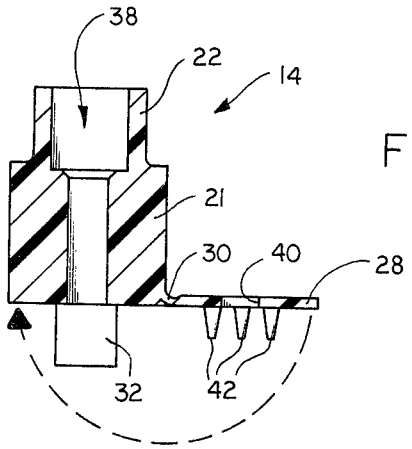
FIG. 4
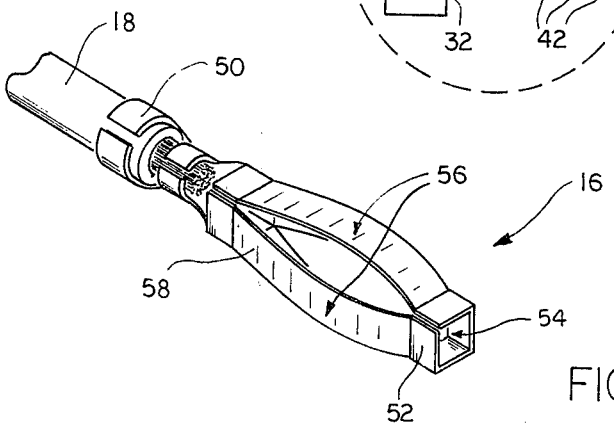
FIG. 5

ELECTRICAL CONNECTOR

BACKGROUND OF THE INVENTION

1. Field of the Invention

The present invention relates to electrical connectors.

2. Brief Description of the Prior Art

Electrical connectors are well known in the art that serve the purpose of simultaneously contacting a plurality of terminals. These types of connectors are commonly referred to as commoning blocks.

In the past, commoning blocks usually included an insulated housing have a plurality of terminal positions, a common conducting material such as metal which interconnected each of the positions, and a plurality of terminals to be received in each of the positions. In this configuration, any two terminals inserted into the housing would be connected to one another.

Although the above described structure is effective to common a plurality of terminals, the manufacture of such a design is relatively expensive because of the necessity of having conducting material interconnecting the different terminal positions.

SUMMARY OF THE INVENTION

It is therefore the principal object of the invention to provide an electrical connector of the type that will commonly connect a plurality of terminals without the need of conductive material interconnecting the terminals.

These and other objects of the present invention are accomplished by one form currently contemplated which provides for an insulated housing and a plurality of like terminals each being received in the housing. The housing includes a hollow chamber portion and a plurality of entrance positions allowing communication into the chamber portion. Each terminal includes a resilient barrel contact portion of larger sized cross section in the remainder of the terminal and is changeable between a normally expanded configuration and any one of a plurality of contracted configurations. The cross section of the terminal while in an expanded configuration is greater in size than the entrance positions. The contact portion of each terminal is contractable to squeeze through an entrance position into the chamber portion whereupon the contact assumes its normal expanded configuration. The entrance positions are spaced a given distance apart from each so that the contact portions of any two terminals inserted into the chamber portion through adjacent entrance positions resiliently press against each other.

BRIEF DESCRIPTION OF THE DRAWINGS

FIG. 1 is a perspective view of the electrical connector of the present invention mounted on a suitable support member;

FIG. 2 is a side section view of the electrical connector of the present invention;

FIG. 3 is a bottom plan view of the housing of the electrical connector of the present invention shown in an unassembled position;

FIG. 4 is a sectional view taken generally along the line 4—4 of FIG. 3; and

FIG. 5 is a perspective view of a terminal used in the electrical connector of the present invention.

DESCRIPTION OF THE PREFERRED EMBODIMENT

Referring now to FIG. 1, the electrical connector of the present invention, generally designated 10, is shown assembled and attached on top of a suitable support member 12. The connector 10 is seen to generally include an insulated housing, generally designated 14, and a plurality of like terminals, generally designated 16, which are electrically connected to a conductor in the form of wire 18.

Turning now to FIGS. 2 and 3, the housing 14 is seen to generally include two hollow chamber portions 20 separated by a middle section 21. The chamber portions 20 are surrounded by a top wall portion 22, two side end walls 24, two side lateral walls 26, and a bottom floor 28 having a thickness thinner than that of the top wall portion 22. As can best be seen in FIGS. 3 and 4, the bottom floor 28 is hinged at 30 to lateral wall 26 for purposes which will become more apparent hereinafter. The floor 28 is movable between an open or unassembled position and a closed or assembled position.

Each end side wall 24 has a depending positioning ear 32 which is adapted to be received through openings 34 formed in the support member 12 as best seen in FIG. 1. A fastener 36 is provided and is adapted to be received through fastener opening 38 formed in the middle section 21 and fastener opening 40 formed in the bottom floor 28. When secured in this position, as is best shown in FIGS. 1 and 2, the fastener secures the connector 10 to the support member 12, in an assembled position.

The bottom floor 28 has a plurality of regularly spaced and positioned cone-like protrusions 42 formed thereon. When the bottom floor 28 is in a closed position, the protrusions 42 point upwardly toward the interior of the top wall portion 22.

The top wall portion 22, which has a thickness somewhat greater than that of the bottom floor 28, has a plurality of regularly spaced and positioned cavities 44 formed therethrough. Each cavity 44 is aligned with and, therefore, corresponds to each one of the protrusions 42. The cavities 44 allow communication into the chamber portions 20 from outside the housing 14.

Looking now at FIGS. 1 and 2, each of the terminals 16 is seen to generally include a crimp portion 50 at one end thereof attached to the wire 18, an indexing end 52 having an opening 54 formed in the bottom thereof, and a barrel-shaped resilient contact portion 56 formed intermediate the crimp portion 50 and the indexing end 52. The contact portion 56 has a generally square cross section and is formed from a plurality of arcuately shaped ribs or walls 58. It is understood that cross section of the contact portion does not necessarily have to be square.

The contact portion 56, at its greatest width, has a larger cross section than that of any of the cavities 44. However, because the contact portion 56 is resilient and contractable, a terminal 16 may be squeezed through the cavity into a chamber portion 20 as best seen in FIG. 2. When thus inserted, the corresponding protrusion 42 is received in the index opening 54 at the bottom of the terminal while the crimp portion 50 is received within the cavity 44. The cavities 44 are spaced a given distance apart so that when two terminals 16 are inserted into the chamber portion 20 through adjacent cavities 44, the contact portions 56 of each terminal will resiliently press against each other as best seen in FIG. 2.

As best seen in FIGS. 1 and 3, the cavities 44 are arranged in a two dimensional X-Y configuration. Because any two adjacent terminals will be resiliently connected to one another, it makes no difference which direction, i.e., whether X or Y, the terminals are placed in the adjacent cavities 44. It is to be understood, however, that the principle of the present invention will work on any array of cavities 44 as long as adjacent cavities are positioned the correct distance apart from one another relative to the cross section of the contact portion 56 of the terminals 16.

The bottom floor 28 is hinged to the remainder of the housing 14 in order to facilitate molding of the housing 14. All that need be done to assemble the housing 14 is to pivot the bottom floor 28 about hinge 30 as is shown in FIG. 4. Fastening the housing 14 in the manner already described to a support member 12 will insure that the bottom floor 28 remains in its closed position.

We claim:

1. An electrical connector comprising:

an insulated housing including a hollow chamber portion and a plurality of entrance positions allowing communication into said chamber portion; and a plurality of like terminals insertable in said housing through said entrance positions each including a crimp portion of a smaller sized cross section than the entrance positions receivable in said entrance position when the terminal is inserted into said housing, each terminal further including a resilient barrel contact portion of a larger sized cross section than the remainder of the terminal and being changeable between a normally expanded configuration and any one of a plurality of contracted configurations, the cross section of said terminal while in an expanded configuration being greater in size than said entrance positions, said contact portion of each terminal being contractable to squeeze through an entrance portion into said chamber portion whereupon said contact portion assumes its normal expanded configuration, said entrance positions being spaced a given distance so that the contact portions of any two terminals inserted into the chamber portion through adjacent entrance positions resiliently press against each other.

2. The connector of claim 1 wherein each position includes an elongated cavity, through which said contact portion must pass in a contracted configuration before entering said chamber portion.

3. The connector of claim 1 wherein said contact portion of said terminal includes a plurality of transversely spaced resilient walls of generally arcuate shape.

4. The connector of claim 3, wherein said contact portion includes four spaced walls which, when formed together, define a generally square cross section.

5. The connector of claim 1, including means cooperating between said terminal and said housing for indexing a terminal within said chamber portion.

6. The connector of claim 5, wherein said housing includes a floor, the interior surface of said floor defining the surface of the chamber portion opposite said entrance positions, said indexing means including a plurality of upstanding protrusions formed on the floor, one opposite each entrance position, and an index opening formed at the end of each terminal adapted to receive said corresponding protrusion.

7. The connector of claim 6 wherein said floor is hinged to the remainder of said housing and is movable between assembled and unassembled positions.

8. The connector of claim 1 wherein said entrance positions form a regular two dimensional array.

9. An electrical connector comprising:

an insulated housing including a hollow chamber portion having two facing walls, one of said walls including a plurality of upstanding protrusions formed on the interior thereof, said other wall having a plurality of cavities formed therethrough, allowing communication into said chamber portion, each cavity being in alignment with one protrusion; and a plurality of like terminals, each including a crimp portion at one end, an indexing portion at the other end having an opening formed therein, and a resilient barrel-shaped contact portion intermediate the ends having a cross section larger than any other portion of the terminal and the size of said cavities, said contact portion being changeable between a normally expanded configuration and any one of a plurality of contracted configurations and is contractable to squeeze through a cavity into said chamber portion whereupon said contact portion assumes its normal expanded configuration and said index opening in the end of the terminal receives the corresponding protrusion to position the terminal, said cavities being transversely spaced a given distance so that the contact portions of any two terminals inserted into the chamber portion through adjacent cavities resiliently press against each other.

10. The connector of claim 9 wherein said contact portion of said terminal includes a plurality of transversely spaced resilient walls of generally arcuate shape.

11. The connector of claim 10 wherein said contact portion include four spaced walls which, when formed together, define a generally square cross section.

12. The connector of claim 9 wherein said floor is hinged to the remainder of said housing and is movable between assembled and unassembled positions.

13. The connector of claim 9 wherein said cavities form a regular two dimensional array.

* * * * *